US010119318B1

(12) United States Patent
Wolf et al.

(10) Patent No.: US 10,119,318 B1
(45) Date of Patent: Nov. 6, 2018

(54) INTEGRATED POWER WINDOW OPERATOR

(71) Applicant: ANDERSEN CORPORATION, Bayport, MN (US)

(72) Inventors: Glen W. Wolf, Owatonna, MN (US); Gregory J. Vetter, Owatonna, MN (US); Scot J. Berkley, Owatonna, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 0 days.

(21) Appl. No.: 15/180,726

(22) Filed: Jun. 13, 2016

Related U.S. Application Data

(60) Provisional application No. 62/174,353, filed on Jun. 11, 2015.

(51) Int. Cl.

| | |
|---|---|
| ***E05F 15/63*** | (2015.01) |
| ***E05C 9/02*** | (2006.01) |
| ***E06B 3/36*** | (2006.01) |
| ***E05C 9/12*** | (2006.01) |
| ***E05C 9/14*** | (2006.01) |
| ***E05C 9/22*** | (2006.01) |

(52) U.S. Cl.
CPC ..... *E05F 15/63* (2015.01); *E05C 9/025* (2013.01); *E05C 9/12* (2013.01); *E05C 9/14* (2013.01); *E05C 9/22* (2013.01); *E06B 3/36* (2013.01); *E05F 2015/631* (2015.01); *E05Y 2900/148* (2013.01)

(58) Field of Classification Search
CPC . E05F 15/63; E05F 11/16; E05F 11/18; E05F 11/08; E05F 11/34; E05C 9/025; E05C 9/12; E05C 9/14
See application file for complete search history.

(56) References Cited

U.S. PATENT DOCUMENTS

| | | | | |
|---|---|---|---|---|
| 2,114,645 A | | 4/1938 | Benschoten et al. | |
| 2,709,582 A | * | 5/1955 | Chapman | E05D 15/44 49/343 |
| 4,497,135 A | * | 2/1985 | Vetter | E05D 15/30 49/252 |
| 4,617,758 A | * | 10/1986 | Vetter | E05F 11/14 49/279 |
| 4,887,392 A | * | 12/1989 | Lense | E05F 11/16 49/300 |
| 5,097,629 A | | 3/1992 | Guhl et al. | |
| 5,199,216 A | * | 4/1993 | Vetter | E05F 5/12 49/109 |
| 5,205,074 A | | 4/1993 | Guhl et al. | |
| 5,226,256 A | * | 7/1993 | Fries | E05B 47/0012 49/13 |
| 5,531,045 A | * | 7/1996 | Piltingsrud | E05F 11/34 49/279 |

(Continued)

FOREIGN PATENT DOCUMENTS

WO WO 2015/140667 A1 9/2015

*Primary Examiner* — Catherine A Kelly
(74) *Attorney, Agent, or Firm* — Mueting, Raasch & Gebhardt, P.A.

(57) ABSTRACT

Power window operators and windows incorporating the power window operators are described herein. The power window operators include both a guide pin and guide pin slot, as well as a pivot pin and pivot pin slot to control movement of an operator arm.

19 Claims, 11 Drawing Sheets

(56) References Cited

U.S. PATENT DOCUMENTS

| | | | | |
|---|---|---|---|---|
| 5,623,784 | A | 4/1997 | Kuersten et al. | |
| 5,813,171 | A * | 9/1998 | Piltingsrud | E05F 15/63 49/139 |
| 6,122,863 | A | 9/2000 | Tippin et al. | |
| 6,915,608 | B2 * | 7/2005 | Labarre | E05F 15/63 49/140 |
| 7,013,604 | B1 | 3/2006 | Moody et al. | |
| 7,452,014 | B2 | 11/2008 | Vetter | |
| 7,708,322 | B2 * | 5/2010 | Timothy | E05C 9/063 292/137 |
| 8,418,404 | B2 | 4/2013 | Runk et al. | |
| 8,677,689 | B1 * | 3/2014 | Draper | E05F 15/63 49/280 |
| 2012/0146342 | A1 | 6/2012 | Bauman | |
| 2016/0130847 | A1 | 5/2016 | Gramstad et al. | |
| 2017/0152695 | A1 * | 6/2017 | Balbo Di Vinadio | E05F 11/14 |

* cited by examiner

INTEGRATED POWER WINDOW OPERATOR

RELATED APPLICATION

This application claims the benefit under 35 U.S.C. Section 119 of U.S. Provisional Patent Application 62/174,353 titled INTEGRATED POWER WINDOW OPERATOR AND LOCK, filed on Jun. 11, 2015, which is hereby incorporated by reference in its entirety.

FIELD OF THE INVENTION

This application generally relates to casement, awning, and other hinged window operators, and in particular to power operators for such windows.

BACKGROUND OF THE INVENTION

Power operators for hinged windows such as casement and awning windows are known in the art. Typically, a drawback of such operators has been that the locks for such windows have been entirely separate, thus requiring sensing devices, triggers, or torque sensing devices to determine that the window is unlocked upon or before actuating the power drive, so as to protect the drive mechanism or window from damage. These prior methods have involved multiple motors, planetary gear systems and triggers that not only need to be precisely aligned and maintained to operate properly, but also additional complexity, and associated cost to build, install, and maintain.

What is needed in the industry are apparatuses and methods that integrate the power drive for a swinging window with the lock mechanism, so as to reduce complexity, and reduce costs to build, install, and maintain a powered window drive mechanism.

SUMMARY OF THE INVENTION

Power window operators and windows incorporating the power window operators are described herein. The power window operators include both a guide pin and guide pin slot, as well as a pivot pin and pivot pin slot to control movement of an operator arm.

In one or more embodiments, the power window operators can be integrated with a lock mechanism, so as to reduce complexity, and reduce costs to build, install, and maintain a powered window drive mechanism.

In one or more embodiments, a motorized window operator which incorporates an integrated locking feature for positioning a pivotal swinging window sash relative to a frame and self-locks when in the normally closed position. The device includes at least one arm that extends between an operator assembly mounted on the window frame and the window sash. One end of the arm is mounted to the operator housing and has a gear section that meshes with a matched helical angle worm gear driven by a motor. The worm gear causes the arm to be extended and retracted with rotational movement about a pivot in the center of the arm gear section to cause the window sash to move with the opposite end of the arm movably connected to the window sash with a guide track. The arm has a pivot point slot originating at the pivot point and is generally parallel to the arm's major axis. When the window sash is closed at the end of the arm rotation, the arm gear section continues to mesh with the motorized worm gear in a lead screw fashion to cause the arm to transition from rotary movement to linear movement and retract horizontally. Guide features are incorporated into the arm and operator housing to help ensure alignment and horizontal movement of the arm. The horizontal movement of the arm creates a locking and unlocking movement effected by a slot on the arm which is perpendicular to the arm's major axis. The slot interfaces with a lock mechanism mounted to the window frame. The lock mechanism interfaces with a keeper on the window sash to lock and unlock the sash.

In a first aspect, one or more embodiments of a window as described herein may include a window frame having a sash rotatable attached to the window frame, wherein the sash moves between a closed position in the window frame and an open position in the window frame. The window further comprises a power window operator that comprises: a motor operably connected to a worm gear and configured to rotate the worm gear about a worm gear axis; an operator arm extending from a first end to a second end, wherein an operator arm axis extends through the first and second ends of the operator arm, and wherein the second end of the operator arm is operably attached to the sash. The operator arm comprises: gear teeth arranged along an arcuate path at the first end of the operator, wherein the gear teeth mesh with the worm gear; a guide pin attached to the operator arm between the first and second ends of the operator arm; and a pivot pin slot formed in the operator arm, wherein the pivot pin slot comprises a first end located closer to the first end of the operator arm than the second end of the operator arm. The power window operator further comprises a housing attached to the window frame, the housing defining a guide pin slot, wherein the operator arm is attached to the housing such that the guide pin on the operator arm is located in the guide pin slot, and wherein the guide pin slot comprises a straight section and an arcuate section, the guide pin slot configured to receive and direct movement of the guide pin along a path that corresponds to the straight section and the arcuate section; and a pivot pin operably attached to the housing, wherein the pivot pin is received in the pivot pin slot of the operator arm when the guide pin is located in the guide pin slot. Rotation of the worm gear in a first direction about the worm gear axis to move the sash from the closed position to the open position moves the operator arm relative to the housing such that the guide pin moves along the straight section and the arcuate section of the guide pin slot. Rotation of the worm gear in the first direction moves the operator arm relative to the housing such that the pivot pin slot moves along the pivot pin until the pivot pin reaches the first end of the pivot pin slot, wherein further rotation of the worm gear rotates the operator arm about the pivot pin at the first end of the pivot pin slot to move the sash from the closed position to the open position. The guide pin is located at a junction of the straight section and the arcuate section of the guide pin slot when the pivot pin reaches the first end of the pivot pin slot as the sash begins to move from the closed position to the open position.

In one or more embodiments of the first aspect of windows described herein, the arcuate section of the guide pin slot and arcuate path of the gear teeth are concentrically aligned with each other when the guide pin is located at a junction between the straight section and the arcuate section of the guide pin slot.

In one or more embodiments of the first aspect of windows described herein, the pivot pin slot and the operator arm axis are aligned with each other.

In one or more embodiments of the first aspect of windows described herein, the pivot pin slot and the straight section of the guide pin slot are aligned with each other when the sash is in the closed position.

In one or more embodiments of the first aspect of windows described herein, the pivot pin slot and the straight section of the guide pin slot are aligned with the operator arm axis when the sash is in the closed position.

In one or more embodiments of the first aspect of windows described herein, rotation of the worm gear in a second direction about the worm gear axis to move the sash to the closed position from the open position moves the operator arm relative to the housing such that the guide pin moves along the arcuate section and the straight section of the guide pin slot; wherein rotation of the worm gear in the second direction about the worm gear axis moves the operator arm relative to the housing such that the operator arm rotates about the pivot pin at the first end of the pivot pin slot to move the sash from the open position to the closed position, followed by movement of the first end of the pivot pin slot away from the pivot pin; and wherein the guide pin is located at a junction of the straight section and the arcuate section of the guide pin slot when the first end of the pivot pin slot starts to move away from the pivot pin.

In one or more embodiments of the first aspect of windows described herein, the window comprises: a lock assembly configured to lock the sash in the closed position; a tie bar operably attached to the lock assembly to move the lock assembly between a locked position and an unlocked position; and the operator arm is configured to engage the tie bar when the sash is in the closed position, wherein movement of the operator arm along the operator arm axis while the guide pin moves along the straight section of the guide pin slot towards and away from the arcuate section of the guide pin slot moves the tie bar between the locked position and the unlocked position. In one or more embodiments, the window comprises a lock interface pin attached to the tie bar, wherein the operator arm comprises a drive notch, and wherein the lock interface pin is engaged with the drive notch when the guide pin is located in the straight section of the guide pin slot, and wherein the drive notch disengages with the lock interface pin when the guide pin moves from the straight section of the guide pin slot into the arcuate section of the guide pin slot.

In a second aspect, one or more embodiments of windows as described herein may include a window frame having a sash rotatable attached to the window frame, wherein the sash moves between a closed position in the window frame and an open position in the window frame. The window further comprises a power window operator that comprises: a motor operably connected to a worm gear and configured to rotate the worm gear about a worm gear axis; an operator arm extending from a first end to a second end, wherein an operator arm axis extends through the first and second ends of the operator arm, and wherein the second end of the operator arm is operably attached to the sash. The operator arm comprises: gear teeth arranged along an arcuate path at the first end of the operator, wherein the gear teeth mesh with the worm gear; a guide pin attached to the operator arm between the first and second ends of the operator arm; and a pivot pin slot formed in the operator arm, wherein the pivot pin slot comprises a first end located closer to the first end of the operator arm than the second end of the operator arm. The power window operator further comprises a housing attached to the window frame, the housing defining a guide pin slot, wherein the operator arm is attached to the housing such that the guide pin on the operator arm is located in the guide pin slot, and wherein the guide pin slot comprises a straight section and an arcuate section, the guide pin slot configured to receive and direct movement of the guide pin along a path that corresponds to the straight section and the arcuate section; and a pivot pin operably attached to the housing, wherein the pivot pin is received in the pivot pin slot of the operator arm when the guide pin is located in the guide pin slot. The window further comprises a lock assembly configured to lock the sash in the closed position; and a tie bar operably attached to the lock assembly to move the lock assembly between a locked position and an unlocked position. Rotation of the worm gear in a first direction about the worm gear axis to move the sash from the closed position to the open position moves the operator arm relative to the housing such that the guide pin moves along the straight section and the arcuate section of the guide pin slot. Rotation of the worm gear in the first direction moves the operator arm relative to the housing such that the pivot pin slot moves along the pivot pin until the pivot pin reaches the first end of the pivot pin slot, wherein further rotation of the worm gear rotates the operator arm about the pivot pin at the first end of the pivot pin slot to move the sash from the closed position to the open position. The guide pin is located at a junction of the straight section and the arcuate section of the guide pin slot when the pivot pin reaches the first end of the pivot pin slot as the sash begins to move from the closed position to the open position. The arcuate section of the guide pin slot and arcuate path of the gear teeth are concentrically aligned with each other when the guide pin is located at a junction between the straight section and the arcuate section of the guide pin slot. The operator arm is configured to engage the tie bar when the sash is in the closed position, wherein movement of the operator arm along the operator arm axis while the guide pin moves along the straight section of the guide pin slot towards and away from the arcuate section of the guide pin slot moves the tie bar between the locked position and the unlocked position.

In one or more embodiments of windows according to the second aspect, rotation of the worm gear in a second direction about the worm gear axis to move the sash to the closed position from the open position moves the operator arm relative to the housing such that the guide pin moves along the arcuate section and the straight section of the guide pin slot; rotation of the worm gear in the second direction about the worm gear axis moves the operator arm relative to the housing such that the operator arm rotates about the pivot pin at the first end of the pivot pin slot to move the sash from the open position to the closed position, followed by movement of the first end of the pivot pin slot away from the pivot pin; and the guide pin is located at a junction of the straight section and the arcuate section of the guide pin slot when the first end of the pivot pin slot starts to move away from the pivot pin.

In one or more embodiments of windows according to the second aspect, the window comprises a lock interface pin attached to the tie bar, wherein the operator arm comprises a drive notch, and wherein the lock interface pin is engaged with the drive notch when the guide pin is located in the straight section of the guide pin slot, and wherein the drive notch disengages with the lock interface pin when the guide pin moves from the straight section of the guide pin slot into the arcuate section of the guide pin slot.

In one or more embodiments of windows as described herein, the window comprises an awning window.

In one or more embodiments of windows as described herein, the window comprises a casement window.

In a third aspect, one or more embodiments of a power window operator as described herein may include: a motor operably connected to a worm gear and configured to rotate the worm gear about a worm gear axis; an operator arm extending from a first end to a second end, wherein an operator arm axis extends through the first and second ends of the operator arm. The operator arm comprises: gear teeth arranged along an arcuate path at the first end of the operator, wherein the gear teeth mesh with the worm gear; a guide pin attached to the operator arm between the first and second ends of the operator arm; and a pivot pin slot formed in the operator arm, wherein the pivot pin slot comprises a first end located closer to the first end of the operator arm than the second end of the operator arm. The power operator further comprises a housing defining a guide pin slot, wherein the operator arm is attached to the housing such that the guide pin on the operator arm is located in the guide pin slot, and wherein the guide pin slot comprises a straight section and an arcuate section, the guide pin slot configured to receive and direct movement of the guide pin along a path that corresponds to the straight section and the arcuate section; and a pivot pin operably attached to the housing, wherein the pivot pin is received in the pivot pin slot of the operator arm when the guide pin is located in the guide pin slot. Rotation of the worm gear in a first direction about the worm gear axis to move the sash from the closed position to the open position moves the operator arm relative to the housing such that the guide pin moves along the straight section and the arcuate section of the guide pin slot. Rotation of the worm gear in the first direction moves the operator arm relative to the housing such that the pivot pin slot moves relative to the housing along the pivot pin until the pivot pin reaches the first end of the pivot pin slot, wherein further rotation of the worm gear rotates the operator arm about the pivot pin at the first end of the pivot pin slot. The guide pin is located at a junction of the straight section and the arcuate section of the guide pin slot when the pivot pin reaches the first end of the pivot pin slot.

In one or more embodiments of the power window operators described herein, the arcuate section of the guide pin slot and arcuate path of the gear teeth are concentrically aligned with each other when the guide pin is located at a junction between the straight section and the arcuate section of the guide pin slot.

In one or more embodiments of the power window operators described herein, the pivot pin slot and the operator arm axis are aligned with each other.

In one or more embodiments of the power window operators described herein, the pivot pin slot and the straight section of the guide pin slot are aligned with each other when the pivot pin is not located at the first end of the pivot pin slot.

In one or more embodiments of the power window operators described herein, the pivot pin slot and the straight section of the guide pin slot are aligned with the operator arm axis when the pivot pin is not located at the first end of the pivot pin slot.

In one or more embodiments of the power window operators described herein, rotation of the worm gear in a second direction about the worm gear axis moves the operator arm relative to the housing such that the guide pin moves along the arcuate section and the straight section of the guide pin slot; wherein rotation of the worm gear in the second direction about the worm gear axis moves the operator arm relative to the housing such that the operator arm rotates about the pivot pin at the first end of the pivot pin slot, followed by movement of the first end of the pivot pin slot away from the pivot pin; and wherein the guide pin is located at a junction of the straight section and the arcuate section of the guide pin slot when the first end of the pivot pin slot starts to move away from the pivot pin.

BRIEF DESCRIPTION OF THE DRAWINGS

The present invention may be more completely understood in consideration of the following detailed description of various illustrative embodiments in connection with the accompanying drawings, in which.

Figure 1A:
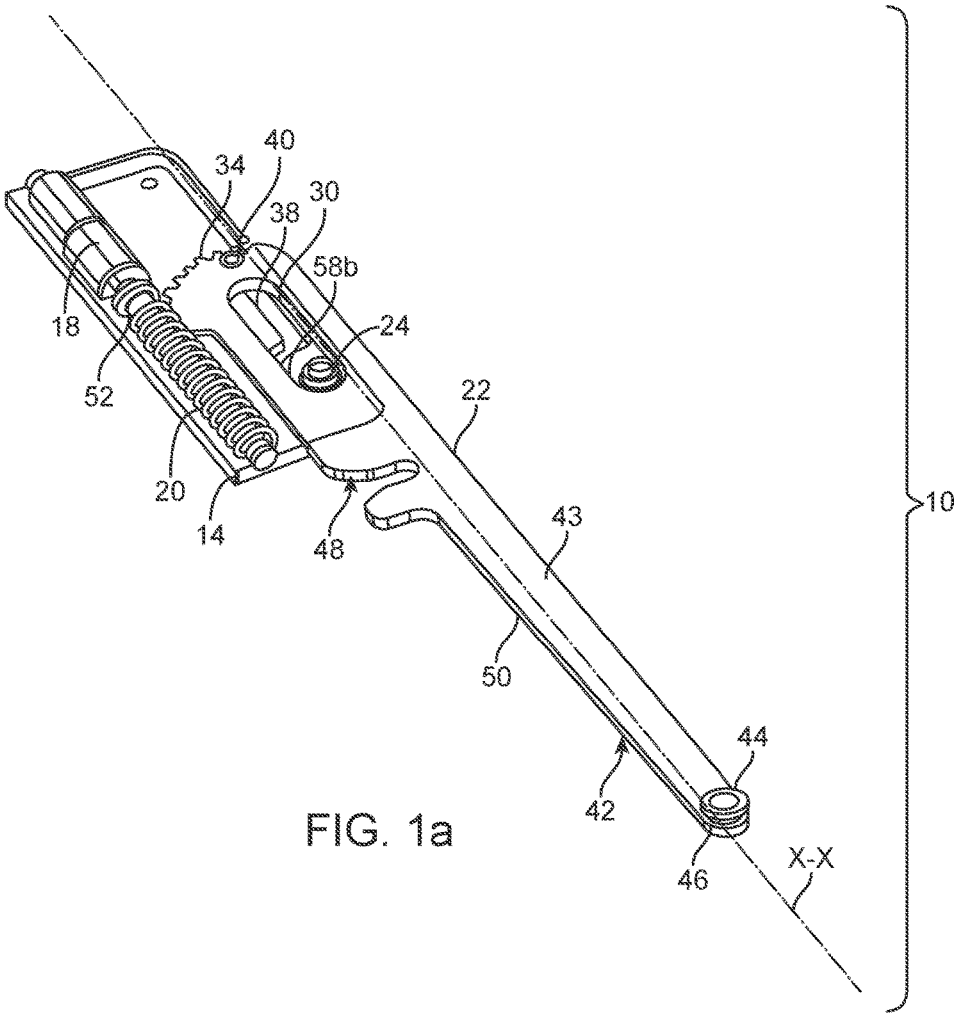
FIG. 1*a* depicts one illustrative embodiment of a motorized window operator as described herein in a locked/closed position, and with a cover 16 as seen in FIG. 2 removed to facilitate viewing of internal components.

While the power window operators and windows described herein are amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

In FIGS. 1*a*-9 there is depicted a motorized window operator 10 and window system according to various illustrative embodiments of the invention. Motorized window operator 10 generally includes a housing formed by a base 14 and top cover 16, along with a drive motor 18, worm gear 20, operator arm 22, and pivot pin 24. Base 14 of the housing defines, in the depicted embodiment, motor recess 26, worm recess 28, guide slot 30, and pin receiving recess 32. Drive motor 18 is received in motor recess 26 and is operably coupled to worm gear 20, which in turn is received in worm recess 28. Pivot pin 24 is received in pin receiving recess 32. Top cover 16 of the illustrative housing defines motor recess 26*a*, worm recess 28*a*, guide slot 30*a*, and pin receiving recess 32*a* structures that register with the corresponding structures in base 14 when top cover 16 is mated with base 14 to form the depicted illustrative housing.

Operator arm 22 defines gear teeth 34 at proximal end 36 and slot 38, the gear teeth arranged along an arcuate path at the proximal end 36. Guide pins 40 project downwardly from bottom side 42 and upwardly from top side 43 near proximal end 36 and are received in guide slot 30 and guide slot 30*a* of base 14, respectively. Pivot pin 24 is slidably received in pivot pin slot 38. Coupling pin 44 is carried at distal end 46 of arm 22. Drive notch 48 is defined in edge 50. Gear teeth 34 are in-mesh with worm gear 20.

According to one or more embodiments of the invention, base 14 of motorized window operator 10 is attached to frame 100 of the window with suitable fasteners (not depicted), and sash 102 is hinged to frame 100 with, e.g., hinge 101. Operator arm 22 is attached to sash 102 with coupling pin 44. Separate locking apparatus 104 is provided on the window system, including tie bar 106, tie bar guide 108, operator interface pin 110 and one or more lock pins 112 on tie bar 106, keepers 114, and (optionally) around-the-corner mechanism 116. In locked and unlocked positions of motorized window operator 10, operator interface pin 110 is received in drive notch 48 of arm 22.

Tie bar 106 and tie bar guides 108 can be known tie bar guide components such as are disclosed in U.S. Published Patent Application No. 2012/0146342 A1, entitled SELF LOCATING TIE BAR GUIDE FOR SASH LOCK TIE BARS or U.S. Pat. No. 7,452,014 B2, entitled MULTI-POINT SASH LOCK SYSTEM FOR CASEMENT WINDOW, said applications being hereby fully incorporated herein by reference. Around-the-corner mechanism 116 may be a known ATC mechanism as disclosed in, e.g., U.S. patent application Ser. No. 14/539,399, entitled AROUND-THE-CORNER MULTI-POINT WINDOW LOCK MECHANISM FOR CASEMENT AND AWNING WINDOWS, and filed Nov. 12, 2014, said application being hereby fully incorporated herein by reference, or any other suitable ATC mechanism.

Figure 1B:
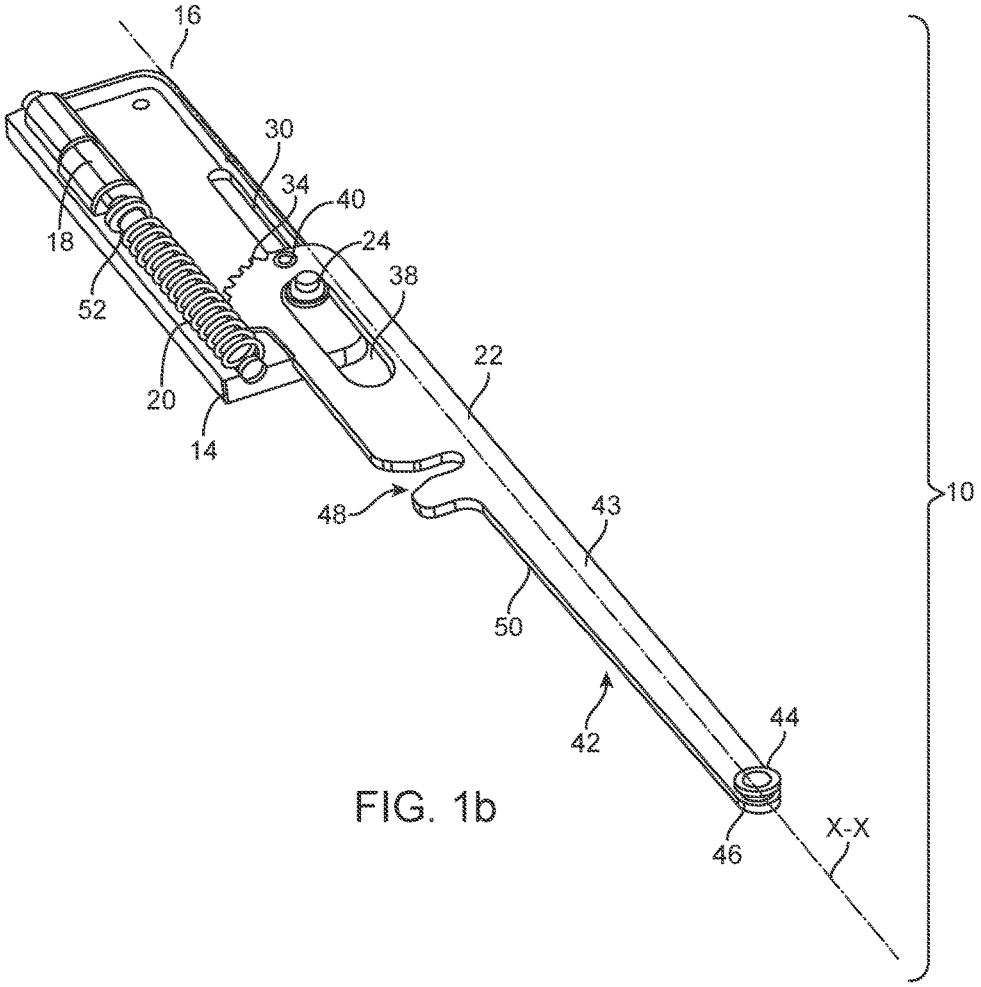
FIG. 1*b* depicts the motorized window operator of FIG. 1*a* in an unlocked/open position, and with a cover 16 as seen in FIG. 2 removed to facilitate viewing of internal components.
Figure 3:
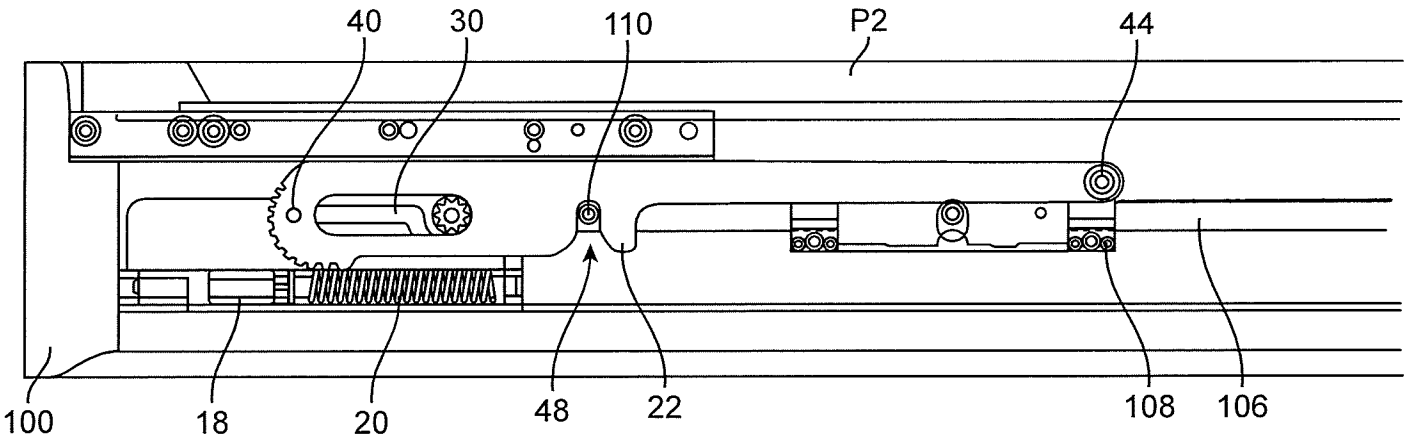
FIG. 3 is a top plan view of another illustrative embodiment of a motorized window operator in a locked/closed position and coupled with a window lock mechanism, with cover 16 as seen in FIG. 2 removed to facilitate viewing of internal components and the sash 102 depicted in broken lines.
Figure 4:
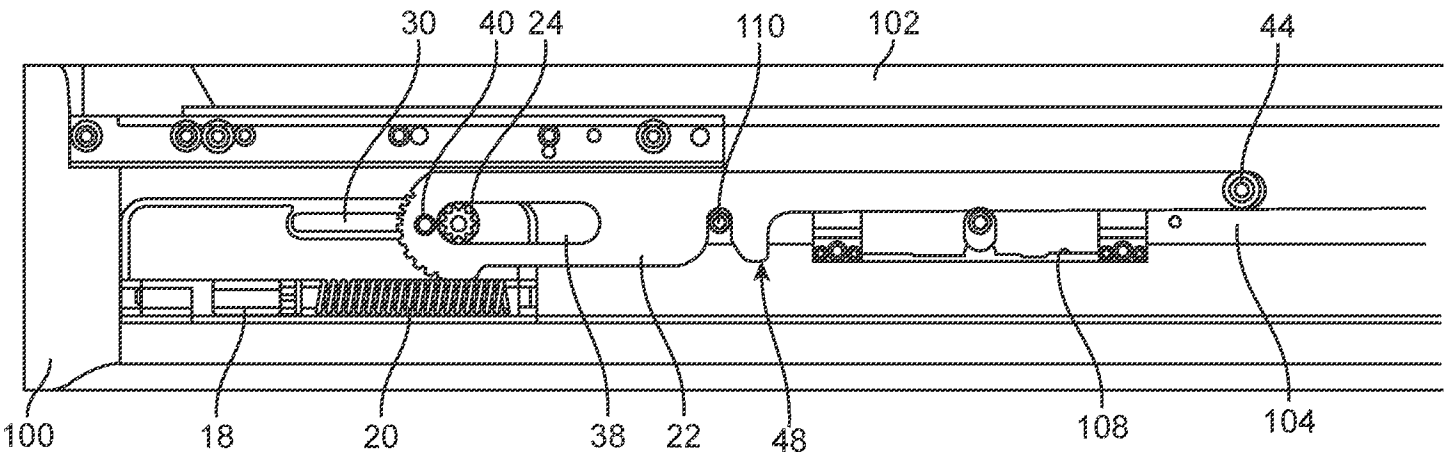
FIG. 4 is a top plan view of another illustrative embodiment of a motorized window operator in an unlocked/open position and coupled with a window lock mechanism, with cover 16 as seen in FIG. 2 removed to facilitate viewing of internal components and the sash 102 depicted in broken lines.
Figure 6:
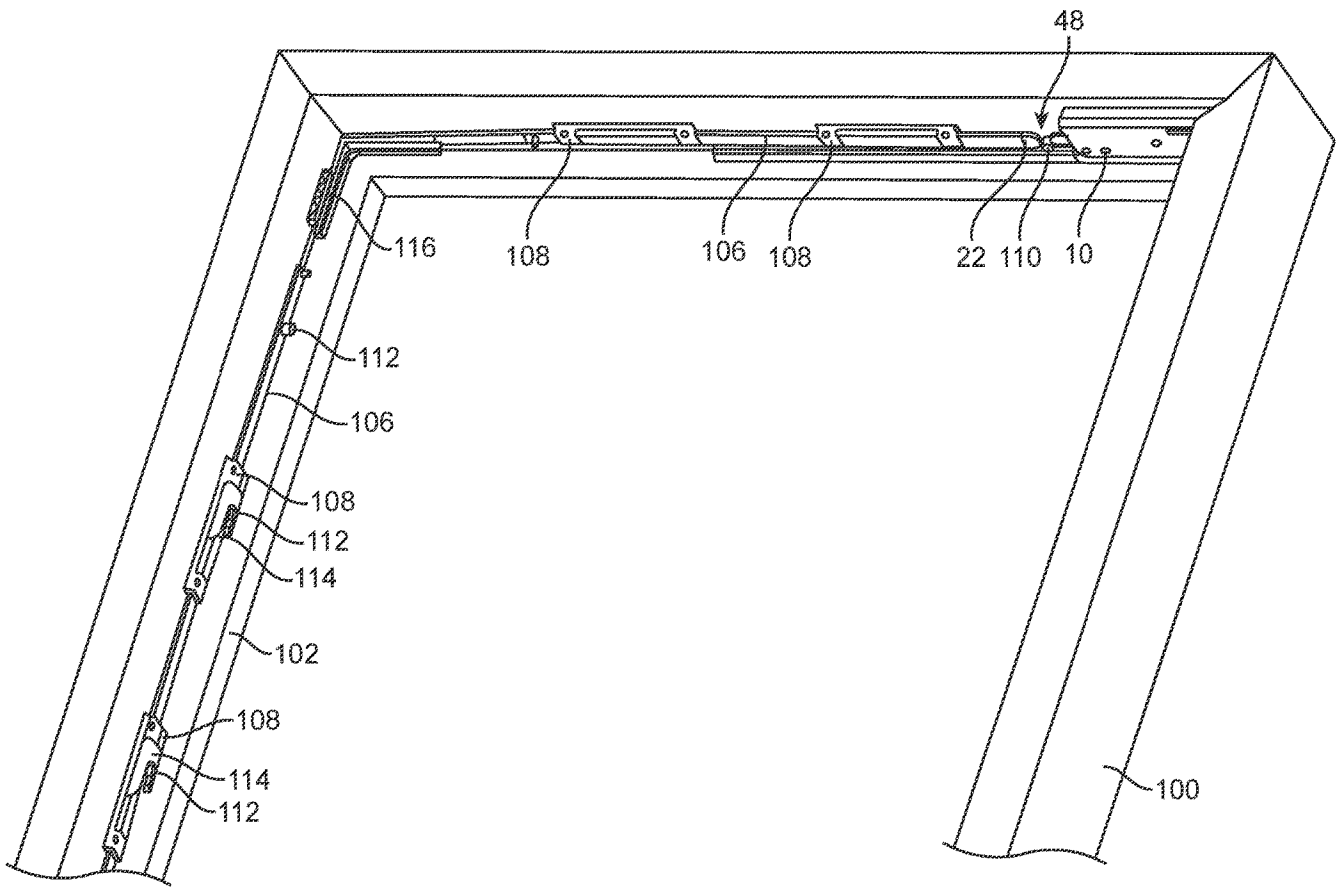
FIG. 6 is a partial isometric view of one illustrative embodiment of a window assembly including a motorized window operator and lock system a s described herein, with the motorized window operator in a locked position.
Figure 7:
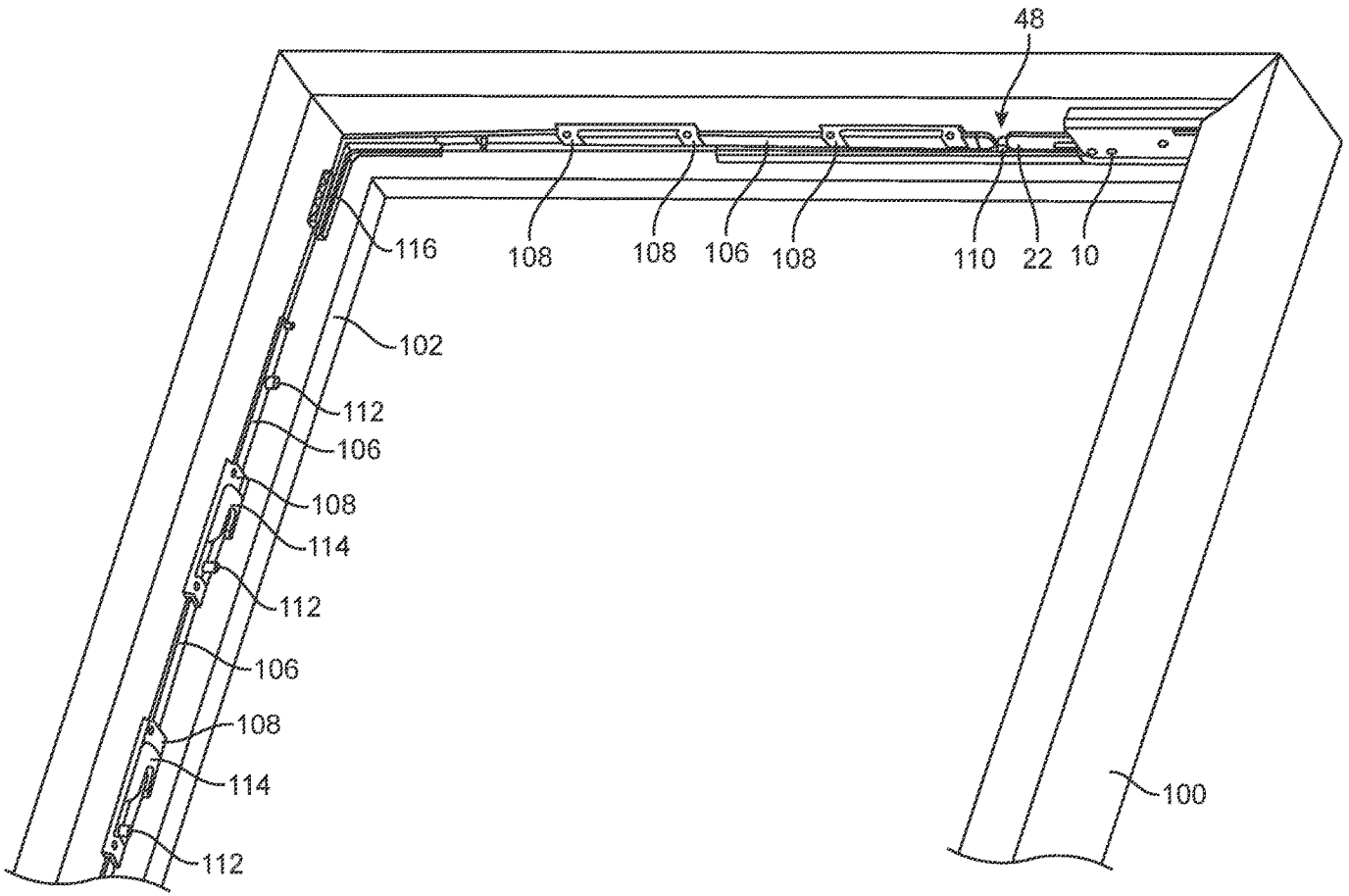
FIG. 7 is a partial isometric view of another illustrative embodiment of a window assembly including a motorized window operator and lock system a s described herein, with the motorized window operator in an unlocked position.

In operation, first end 51 of gear teeth 34 are in-mesh with worm gear 20 at proximal end 52 of worm 20 as depicted in FIGS. 1*a*, 3, and 6. Sash 102 is locked to frame 100, due to the engagement of lock pins 112 with keepers 114. Pivot pin 24 is positioned at proximal end 54 of pivot pin slot 38. Upon application of power to drive motor 18, worm gear 20 is rotated so that operator arm 22 is translated along longitudinal operator arm axis X-X so that the distal end 56 of pivot pin slot 38 approaches pivot pin 24, and guide pins 40 move along the straight section of guide pin path 30 as they approach curved/arcuate sections 58*a*, 58*b* of guide slots 30, 30*a*, respectively, as depicted in FIGS. 1*b*, 4, and 7. Due to the engagement of operator lock interface pin 110 in drive notch 48 of operator arm 22, tie bar 106 is shifted in tie bar guide 108 so that lock pins 112 are disengaged from keepers 114, thereby unlocking sash 102 from frame 100 and enabling pivotal movement of sash 102 relative to frame 100.

Figure 1C:
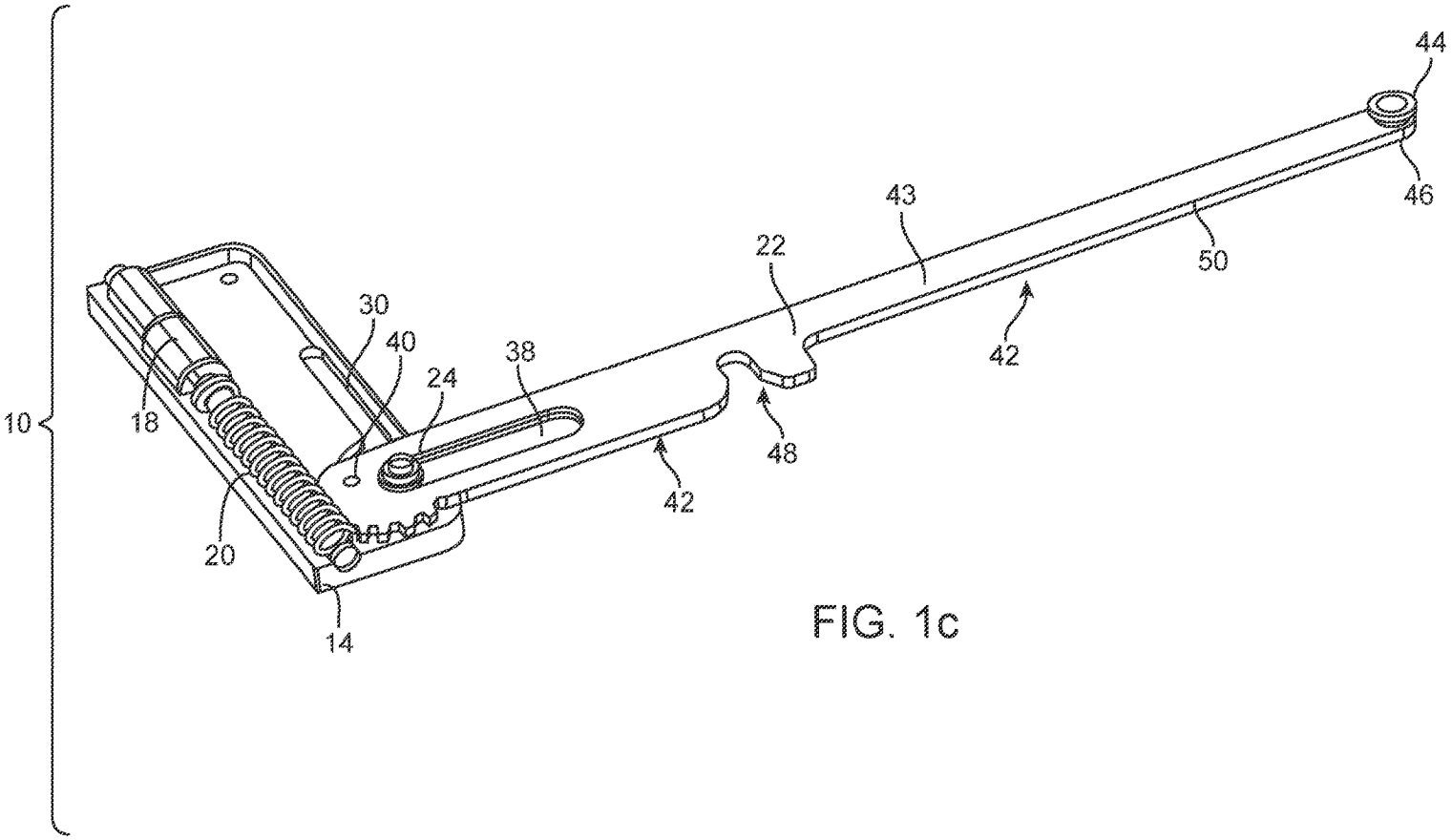
FIG. 1*c* depicts the motorized window operator of FIG. 1*c* in a window sash open position, and with a cover 16 as seen in FIG. 2 removed to facilitate viewing of internal components.
Figure 2:
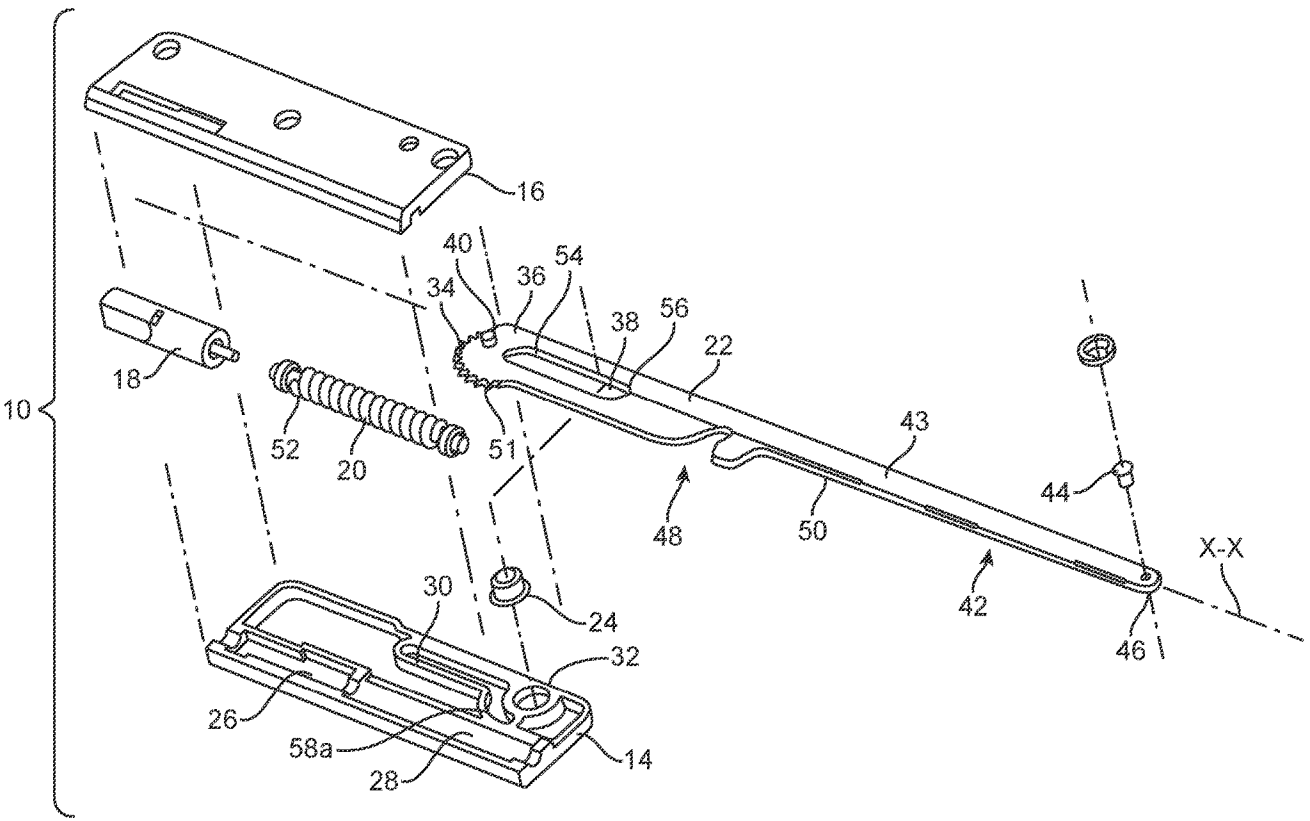
FIG. 2 is an exploded view of the motorized window operator of FIG. 1*a;*
Figure 5:
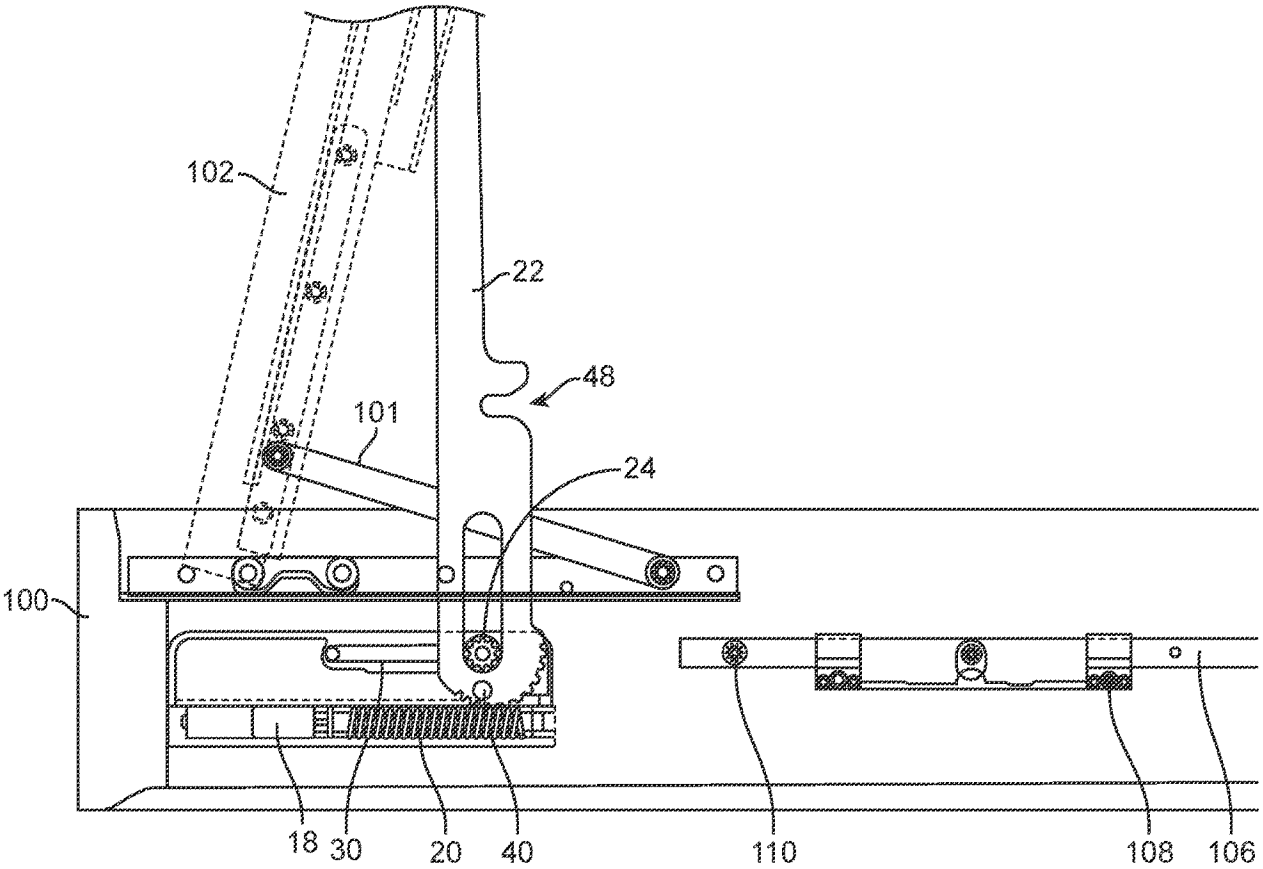
FIG. 5 is a top plan view of another illustrative embodiment of a motorized window operator in a window sash open position and coupled with a window lock mechanism, with cover 16 as seen in FIG. 2 removed to facilitate viewing of internal components and the sash 102 depicted in broken lines.
Figure 8:
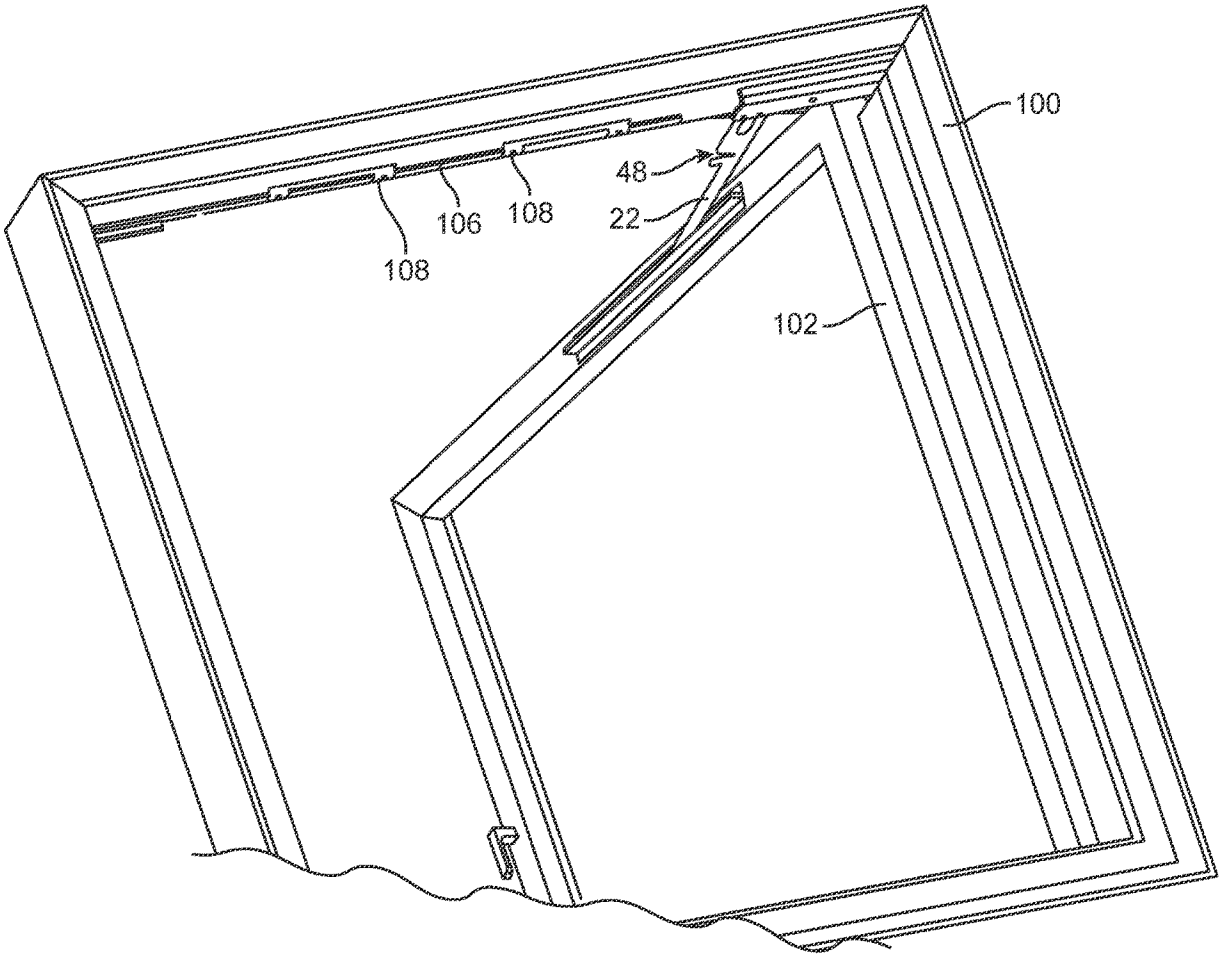
FIG. 8 is a partial isometric view of another illustrative embodiment of another illustrative embodiment of a window assembly including a motorized window operator and lock system as described herein, with the motorized window operator in a window open position.
Figure 9:
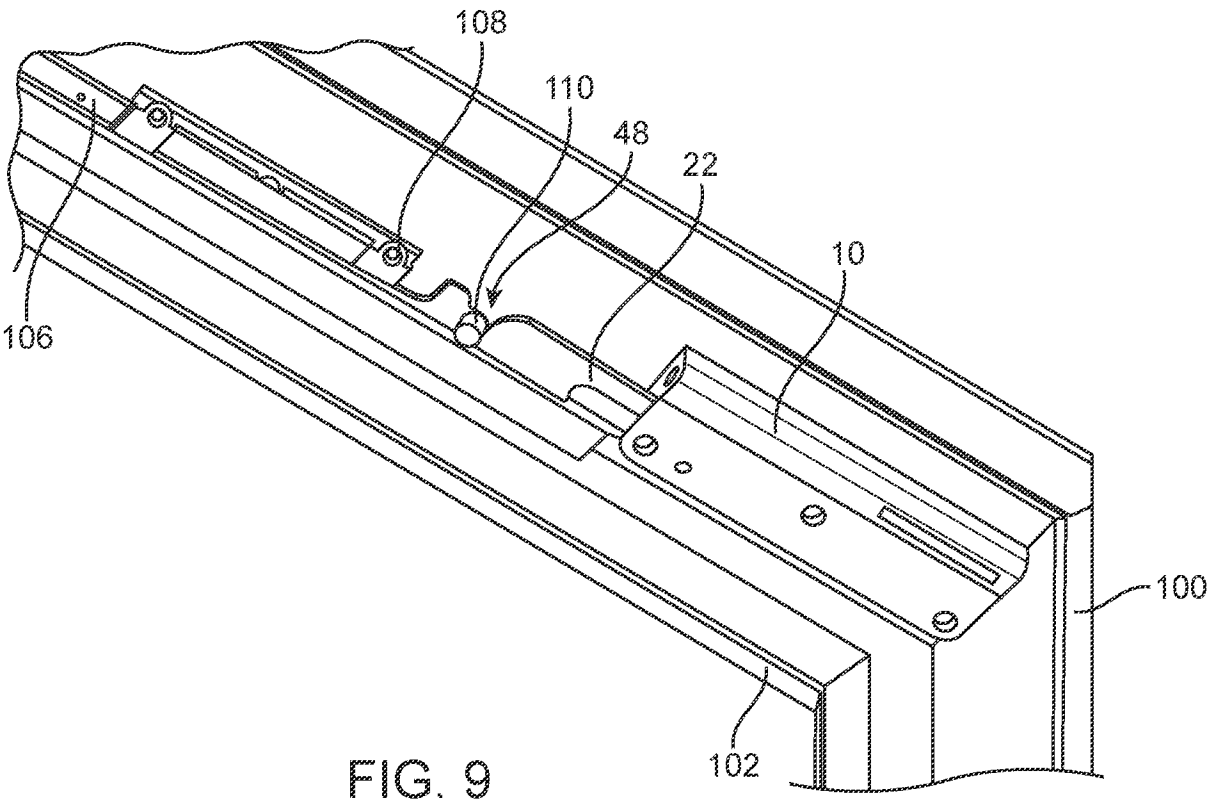
FIG. 9 is a partial isometric view of another illustrative embodiment of a window assembly including a motorized window operator and lock system a s described herein, depicting the interconnection of the operator with a lock tie bar.

Once pivot pin 24 reaches distal end 56 of the pivot pin slot 38, and guide pins 40 begin to slide along the arcuate sections 58*a*, 58*b* of guide pin slot 30, distal end of 46 of operator arm 22 begins to pivot outwardly about pivot pin 24, due to the curved arrangement of gear teeth 34 along proximal end 52 of operator arm 22 and the shape of arcuate sections 58*a*, 58*b* of guide slot 30, thereby pivoting sash 102 outwardly relative to frame 100, as depicted in FIGS. 1*c*, 5, and 8.

When power is applied to drive motor 18 so as to reverse the direction of rotation of the worm gear 20, operator arm 22 pivots inwardly, pivoting sash 102 toward frame 100 about pivot pin 24, due to the engagement of gear teeth 34 with worm gear 20, and according to the path defined by arcuate sections 58*a*, 58*b*, of guide pin slots 30, 30*a*. Once operator arm 22 reaches the unlocked position depicted in FIGS. 1*b*, 4, and 7, operator interface pin 110 reengages in drive notch 48 of operator arm 22, and operator arm 22 translates in the opposite direction along longitudinal arm axis X-X, and shifts tie bar 106 in tie bar guide 108 so that lock pins 112 are reengaged in keepers 114, so that sash 102 is again locked to frame 100.

It will be appreciated that the motorized window operator according to embodiments of the invention can be used with currently available casement and awning window multi-point locking systems. In that regard, a linear sliding linkage or tie bar can communicate horizontal operator arm motion to a lock mechanism mounted on the same side of the window frame to which the operator is mounted.

Furthermore, the linear worm drive mechanism employed to drive the operator arm horizontally provides a low profile operator to make it easier to hide under window stops. The operator can be mounted at the top head or bottom sill of the window frame for casement style windows and utilize an around-the-corner (ATC) device to transition to a lock mechanism located on the side jamb. The motorized operator could also be located in the side jamb of the window frame for casement style windows to avoid having to use an ATC device to drive the lock mechanism. Moreover, locating the operator at the top sill or on the side jamb of the window frame helps protect it from water issues. Keepers can be mounted to the window frame, and the operator arm can engage directly into and out of these keepers to perform the locking function.

Still further, it will be appreciated that two arms could be driven by opposing worm gear helical angles similar to a traditional scissors-arm awning operator to improve load carrying capability on an awning window. Various methods might be used to accomplish this including: a motor could be used to drive a bevel gear which perpendicularly intersects and drives two separate worm gears with the same helical angle concurrently in opposite rotational directions; a motor could be applied to the end of a single worm gear made with two separate sections of opposing helical angles; a double ended motor could be located in the middle of two worm gears made with opposing helical angles; or a separate motor drive for each worm gear could be used.

Benefits of apparatuses and systems according to embodiments of the invention are not limited to powered swinging windows, since as a perpendicularly intersecting bevel gear could be used to drive the worm manually so as to provide integration of the window opening and closing functions with the locking and unlocking functions. The motor could extend into a hole in the window frame and adjacent wall, but still could be serviceable from the window without needing an access panel in the window frame or wall. And any hole in the upper or side window frame would not have the water issues that a similar hole at the sill might potentially have.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

The foregoing descriptions present numerous specific details that provide a thorough understanding of various embodiments of the invention. It will be apparent to one skilled in the art that various embodiments, having been disclosed herein, may be practiced without some or all of these specific details. In other instances, components as are known to those of ordinary skill in the art have not been described in detail herein in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments may be constructed that nevertheless employ the principles and spirit of the present invention. Accordingly, this application is intended to cover any adaptations or variations of the invention.

For purposes of interpreting the claims for the present invention, it is expressly intended that the provisions of 35 U.S.C. § 112(f) are not to be invoked unless the specific terms "means for" or "step for" are recited in a claim.

What is claimed is:

1. A window comprising a window frame having a sash rotatable attached to the window frame, wherein the sash moves between a closed position in the window frame and an open position in the window frame, wherein the window further comprises a power window operator that comprises:

a motor operably connected to a gear and configured to rotate the gear about a gear axis;

an operator arm extending from a first end to a second end, wherein an operator arm axis extends through the first and second ends of the operator arm, and wherein the second end of the operator arm is operably attached to the sash, and further wherein the operator arm comprises:

gear teeth arranged along an arcuate path at the first end of the operator arm, wherein the gear teeth mesh with the gear;

a pivot pin slot formed in the operator arm, wherein the pivot pin slot comprises a first end located closer to the first end of the operator arm than the second end of the operator arm and a second end located further away from the first end of the operator arm than the first end of the pivot pin slot;

a housing attached to the window frame; and a pivot pin operably attached to the housing, wherein the pivot pin is received in the pivot pin slot of the operator arm;

a lock assembly configured to lock the sash in the closed position; and a tie bar attached to the window frame and configured to move along the window frame between a locked position and an unlocked position, wherein the tie bar comprises a lock interface pin attached to the tie bar, wherein the tie bar extends around at least one corner of the window frame, and wherein the tie bar is operably attached to the lock assembly such that the lock assembly moves to a locked configuration when the tie bar moves to the locked position and the lock assembly moves to an unlocked configuration when the tie bar moves to the unlocked position; and a drive notch in the operator arm, the drive notch located between the first end of the pivot pin slot and the second end of the operator arm, wherein the lock interface pin on the tie bar is engaged with the drive notch when the pivot pin is located at the second end of the pivot pin slot;

wherein, when the sash in the closed position, the pivot pin is located at the second end of the pivot pin slot, and the tie bar is in the locked position, rotation of the gear in a first direction moves the operator arm along the operator arm axis relative to the housing such that the pivot pin slot moves along the pivot pin until the pivot pin is positioned at the first end of the pivot pin slot and the drive notch and the lock interface pin are engaged to move the tie bar into the unlocked position which moves the lock assembly to the unlocked configuration;

wherein further rotation of the gear in the first direction after the pivot pin is positioned at the first end of the pivot pin slot rotates the operator arm about the pivot pin at the first end of the pivot pin slot such that the drive notch disengages from the lock interface pin and the sash moves from the closed position to the open position;

wherein rotation of the gear in a second direction after the sash is in the open position rotates the operator arm about the pivot pin at the first end of the pivot pin slot to move the sash to the closed position and move the drive notch into engagement with the lock interface pin;

wherein further rotation of the gear in the second direction after moving the sash from the open position to the closed position moves the operator arm along the operator arm axis relative to the housing such that the pivot pin slot moves along the pivot pin until the pivot pin is positioned at the second end of the pivot pin slot and the tie bar moves into the locked position which moves the lock assembly to the locked configuration.

2. A window according to claim 1, wherein the pivot pin slot and the operator arm axis are aligned with each other.

3. A window according to claim 1, wherein the window comprises an awning window.

4. A window according to claim 1, wherein the window comprises a casement window.

5. A window according to claim 1, wherein, when the sash is in the closed position, the drive notch on the operator arm is engaged with the lock interface pin:

when the tie bar is in the locked position, when the tie bar is in the unlocked position, when the tie bar is moving from the locked position to the unlocked position, and when the tie bar is moving from the unlocked position to the locked position.

6. A window according to claim 1, wherein the drive notch in the operator arm begins to move away from the lock interface pin to disengage from the lock interface pin at the same time as the sash begins to move away from the window frame when rotating the gear in the first direction.

7. A window according to claim 1, wherein movement of the tie bar between the locked position and the unlocked position is along a direction aligned with the operator arm axis when the sash in the closed position and the pivot pin is located at the second end of the pivot pin slot.

8. A window according to claim 1, wherein the pivot pin slot comprises a uniform width transverse to the operator arm axis between the first end and the second end of the pivot pin slot.

9. A window according to claim 1, wherein the pivot pin slot comprises a uniform width transverse to the operator arm axis between the first end and the second end of the pivot pin slot, and wherein the pivot pin comprises a circular pin attached to the housing.

10. A window according to claim 1, wherein the lock assembly comprises a lock pin on the tie bar and a keeper attached to the sash, wherein the lock pin engages the keeper when the lock assembly is in the locked configuration and the sash is in the closed position, and wherein the lock pin is disengaged from the keeper when the lock assembly is in the unlocked configuration and the tie bar is in the unlocked position.

11. A window according to claim 10, wherein, when the sash in the closed position, the pivot pin is located at the second end of the pivot pin slot, and the tie bar is in the locked position, rotation of the gear in a first direction moves the operator arm along the operator arm axis relative to the housing such that the pivot pin slot moves along the pivot pin until the pivot pin is positioned at the first end of the pivot pin slot and the drive notch and the lock interface pin are engaged to move the tie bar into the unlocked position in which the lock pin disengages from the keeper;

wherein further rotation of the gear in the first direction after the pivot pin is positioned at the first end of the pivot pin slot rotates the operator arm about the pivot pin at the first end of the pivot pin slot such that the drive notch disengages from the lock interface pin and the sash moves from the closed position to the open position;

wherein rotation of the gear in a second direction after the sash is in the open position rotates the operator arm about the pivot pin at the first end of the pivot pin slot to move the sash to the closed position and move the drive notch into engagement with the lock interface pin;

wherein further rotation of the gear in the second direction after moving the sash from the open position to the closed position moves the operator arm along the operator arm axis relative to the housing such that the pivot pin slot moves along the pivot pin until the pivot pin is positioned at the second end of the pivot pin slot and the tie bar moves into the locked position in which the lock pin on the tie bar engages the keeper on the sash.

12. A window according to claim 1, wherein the drive notch is located closer to the second end of the pivot pin slot than the second end of the operator arm.

13. A window comprising a window frame having a sash rotatable attached to the window frame, wherein the sash moves between a closed position in the window frame and an open position in the window frame, wherein the window further comprises a power window operator that comprises:

a motor operably connected to a gear and configured to rotate the gear about a gear axis;

an operator arm extending from a first end to a second end, wherein an operator arm axis extends through the first and second ends of the operator arm, and wherein the second end of the operator arm is operably attached to the sash, and further wherein the operator arm comprises:

gear teeth arranged along an arcuate path at the first end of the operator arm, wherein the gear teeth mesh with the gear;

a pivot pin slot formed in the operator arm, wherein the pivot pin slot comprises a first end located closer to the first end of the operator arm than the second end of the operator arm and a second end located further away from the first end of the operator arm than the first end of the pivot pin slot;

a housing attached to the window frame; and a pivot pin operably attached to the housing, wherein the pivot pin is received in the pivot pin slot of the operator arm;

a lock assembly configured to lock the sash in the closed position; and a tie bar attached to the window frame and configured to move along the window frame between a locked position and an unlocked position, wherein the tie bar comprises a lock interface pin attached to the tie bar, wherein the tie bar extends around at least one corner of the window frame, and wherein the tie bar is operably attached to the lock assembly such that the lock assembly moves to a locked configuration when the tie bar moves to the locked position and the lock assembly moves to an unlocked configuration when the tie bar moves to the unlocked position; and a drive notch in the operator arm, the drive notch located between the first end of the pivot pin slot and the second end of the operator arm, wherein the lock interface pin on the tie bar is engaged with the drive notch when the pivot pin is located at the second end of the pivot pin slot;

wherein, when the sash in the closed position, the pivot pin is located at the second end of the pivot pin slot, and the tie bar is in the locked position, rotation of the gear in a first direction moves the operator arm along the operator arm axis relative to the housing such that the pivot pin slot moves along the pivot pin until the pivot pin is positioned at the first end of the pivot pin slot and the drive notch and the lock interface pin are engaged to move the tie bar into the unlocked position which moves the lock assembly to the unlocked configuration;

wherein, when the sash is in the closed position, the drive notch on the operator arm is engaged with the lock interface pin:

when the tie bar is in the locked position, when the tie bar is in the unlocked position, when the tie bar is moving from the locked position to the unlocked position, and when the tie bar is moving from the unlocked position to the locked position;

wherein further rotation of the gear in the first direction after the pivot pin is positioned at the first end of the pivot pin slot rotates the operator arm about the pivot pin at the first end of the pivot pin slot such that the drive notch disengages from the lock interface pin and the sash moves from the closed position to the open position;

wherein the drive notch in the operator arm begins to move away from the lock interface pin to disengage from the lock interface pin at the same time as the sash begins to move away from the window frame when rotating the gear in the first direction;

wherein rotation of the gear in a second direction after the sash is in the open position rotates the operator arm about the pivot pin at the first end of the pivot pin slot to move the sash to the closed position and move the drive notch into engagement with the lock interface pin; wherein further rotation of the gear in the second direction after moving the sash from the open position to the closed position moves the operator arm along the operator arm axis relative to the housing such that the pivot pin slot moves along the pivot pin until the pivot pin is positioned at the second end of the pivot pin slot and the tie bar moves into the locked position which moves the lock assembly to the locked configuration.

14. A window according to claim 13, wherein movement of the tie bar between the locked position and the unlocked position is along a direction aligned with the operator arm axis when the sash in the closed position and the pivot pin is located at the second end of the pivot pin slot.

15. A window according to claim 13, wherein the pivot pin slot comprises a uniform width transverse to the operator arm axis between the first end and the second end of the pivot pin slot.

16. A window according to claim 13, wherein the pivot pin slot comprises a uniform width transverse to the operator arm axis between the first end and the second end of the pivot pin slot, and wherein the pivot pin comprises a circular pin attached to the housing.

17. A window according to claim 13, wherein the lock assembly comprises a lock pin on the tie bar and a keeper attached to the sash, wherein the lock pin engages the keeper when the lock assembly is in the locked configuration and the sash is in the closed position, and wherein the lock pin is disengaged from the keeper when the lock assembly is in the unlocked configuration and the tie bar is in the unlocked position.

18. A window according to claim 17, wherein the lock pin is located on the tie bar distal from the operator such that the tie bar extends around the at least one corner of the frame between the lock pin and the housing.

19. A window according to claim 17, wherein, when the sash in the closed position, the pivot pin is located at the second end of the pivot pin slot, and the tie bar is in the locked position, rotation of the gear in a first direction moves the operator arm along the operator arm axis relative to the housing such that the pivot pin slot moves along the pivot pin until the pivot pin is positioned at the first end of the pivot pin slot and the drive notch and the lock interface pin are engaged to move the tie bar into the unlocked position in which the lock pin disengages from the keeper;

wherein further rotation of the gear in the first direction after the pivot pin is positioned at the first end of the pivot pin slot rotates the operator arm about the pivot pin at the first end of the pivot pin slot such that the drive notch disengages from the lock interface pin and the sash moves from the closed position to the open position;

wherein rotation of the gear in a second direction after the sash is in the open position rotates the operator arm about the pivot pin at the first end of the pivot pin slot to move the sash to the closed position and move the drive notch into engagement with the lock interface pin;

wherein further rotation of the gear in the second direction after moving the sash from the open position to the closed position moves the operator arm along the operator arm axis relative to the housing such that the pivot pin slot moves along the pivot pin until the pivot pin is positioned at the second end of the pivot pin slot and the tie bar moves into the locked position in which the lock pin on the tie bar engages the keeper on the sash.

* * * * *